US005097954A

United States Patent [19]

Phillips

[11] Patent Number: 5,097,954

[45] Date of Patent: Mar. 24, 1992

[54] PACKAGE ORGANIZATION

[76] Inventor: Gregory J. Phillips, 77625 Jacob St., Maringouin, La. 70757

[21] Appl. No.: 673,198

[22] Filed: Mar. 21, 1991

[51] Int. Cl.[5] ..... B65D 73/00

[52] U.S. Cl. ..... 206/457; 40/312; 40/439; 206/459

[58] Field of Search ..... 40/312, 439; 206/457, 206/459

[56] References Cited

U.S. PATENT DOCUMENTS 1,628,121 5/1927 Covel ..... 206/457 X 2,593,966 4/1952 Born ..... 40/312 X

*Primary Examiner*—William I. Price

*Attorney, Agent, or Firm*—Leon Gilden

[57] ABSTRACT

An organization for display and entertainment of individuals includes a lid receiving an underlying container therewithin. A first embodiment of the invention includes a lid formed with a pre-inscribed message, such as for a particular greeting and the like, with a further space position below for a personalized signature in association with the greeting. Modifications of the invention include the greeting mounted on a bellows that is selectively expandable utilizing pneumatic pressurization of the bellows formed in a two-part structure to effect stage filling of a bellows member.

4 Claims, 4 Drawing Sheets

PRIOR ART 10
14
13
11
12
15
GREETINGS 17
18
16
13
15
11
SIGNATURE

PACKAGE ORGANIZATION

BACKGROUND OF THE INVENTION

1. Field of the Invention

The field of invention relates to package structure, and more particularly pertains to a new and improved package organization wherein the same is arranged to incorporate a pre-inscribed greeting message on a top surface of the lid of a package.

2. Description of the Prior Art

Packages of various types have been utilized in the prior art to convey interest, concern, and other emotional communication with a receiver of the package as directed by a sender. Such structure is exemplified in the prior art in U.S. Pat. No. 3,370,779 to Cole setting forth a package with a prepositioned tie member and a gift card mounted overlying the package structure.

U.S. Pat. No. 3,515,332 to Smith sets forth a further example of a package, with a surmounted configuration to overlie the package surface.

U.S. Pat. No. 1,684,244 to Richardson sets forth a further carton assemblage utilizing a designated figure to form a portion of an amusement aspect of the package when in an assembled configuration.

As such, it may be appreciated that there continues to be a need for a new and improved package organization as set forth by the instant invention which addresses both the problems of ease of use as well as effectiveness in construction in presenting a message in conveyance from a sender to a receiver of the package and in this respect, the present invention substantially fulfills this need.

SUMMARY OF THE INVENTION

In view of the foregoing disadvantages inherent in the known types of package structure now present in the present art, the present invention provides a package organization wherein the same utilizes a pre-inscribed message imprinted or formed within the lid structure of the package organization. As such, the general purpose of the present invention, which will be described subsequently in greater detail, is to provide a new and improved package organization which has all the advantages of the prior art package structures and none of the disadvantages.

To attain this, the present invention provides an organization for display and entertainment of individuals, including a lid receiving an underlying container therewithin. A first embodiment of the invention includes a lid formed with a pre-inscribed message, such as for a particular greeting and the like, with a further space position below for a personalized signature in associated with the greeting. Modifications of the invention include the greeting mounted on a bellows that is selectively expandable utilizing pneumatic pressurization of the bellows formed in a two-part structure to effect stage filling of a bellows member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof there follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved package organization which has all the advantages of the prior art package structures and none of the disadvantages.

It is another object of the presence invention to provide a new and improved package organization which may be easily and efficiently manufactured and marketed.

It is a further object of the present invention to provide a new and improved package organization which is of a durable and reliable construction.

An even further object of the present invention is to provide a new and improved package organization which is susceptible of a low cost of manufacture with regard to both materials and labor, and which accordingly is then susceptible of low prices of sale to the consuming public, thereby making such package organizations economically available to the buying public.

Still yet another object of the present invention is to provide a new and improved package organization which provides in the apparatuses and methods of the prior art some of the advantages thereof, while simultaneously overcoming some of the disadvantages normally associated therewith.

Still another object of the present invention is to provide a new and improved package organization wherein the same utilizes a stage bellows organization to provide enhanced amusement and enjoyment of the package when directed to a sender thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
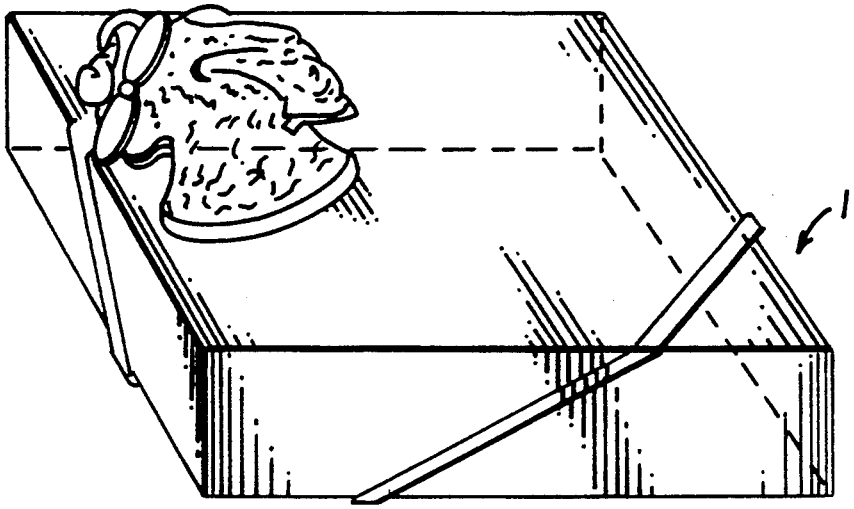
FIG. 1 is an isometric illustration of a prior art package structure.
Figure 2:
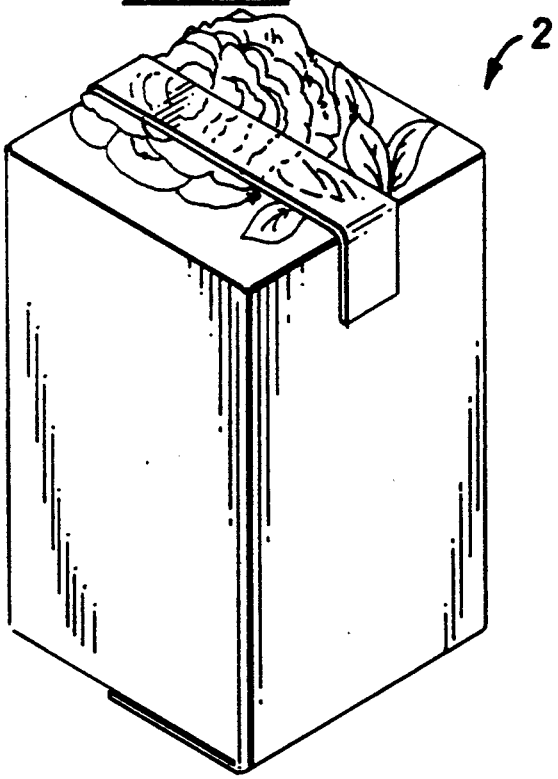
PRIOR ART FIG 2
FIG. 2 is a further example of a prior art package structure.
Figure 3:
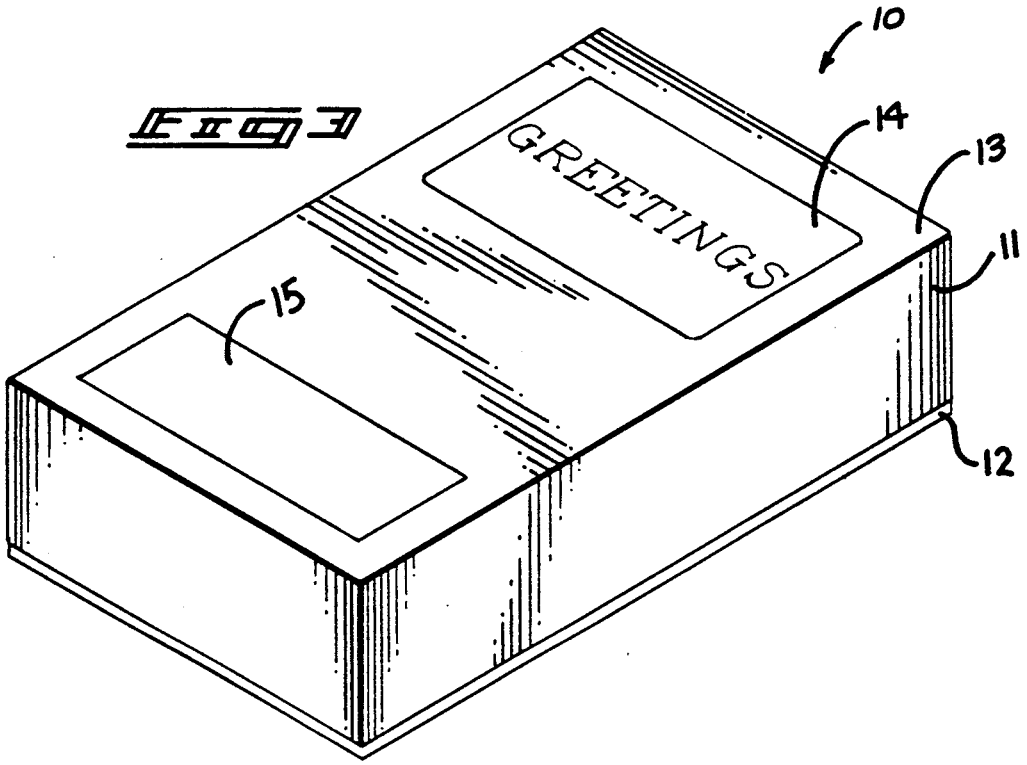
FIG. 3 is an isometric illustration of the instant invention.

With reference now to the drawings, and in particular to FIGS. 1 to 8 thereof, a new and improved packaging organization embodying the principles and concepts of the present invention and generally designated by the reference numeral 10 will be described.

FIG. 1 illustrates a typical prior art packaging container, as depicted in U.S. Pat. No. 3,370,779, wherein the package 1 utilizes ornamentation secured in overyling relationship relative to a top surface of the lid of package. U.S. Pat. No. 3,515,332 to FIG. 2 sets forth a further package organization 2 presenting a package structure, with a figure construction mounted in securement to a top surface of the package.

More specifically, the package organization 10 of the instant invention essentially comprises a container lid 11 formed with a surrounding downwardly depending skirt 11*a*, and including a lid top surface 13 to receive an underlying container member 12 therewithin. A greeting card message 14 is integrally formed in an imprinted configuration relative to the top surface 13 utilizing a signature space 15 positioned in a spaced relationship relative to the greeting card message 14 for personalizing the package directed to a receiving individual.

Figure 4:
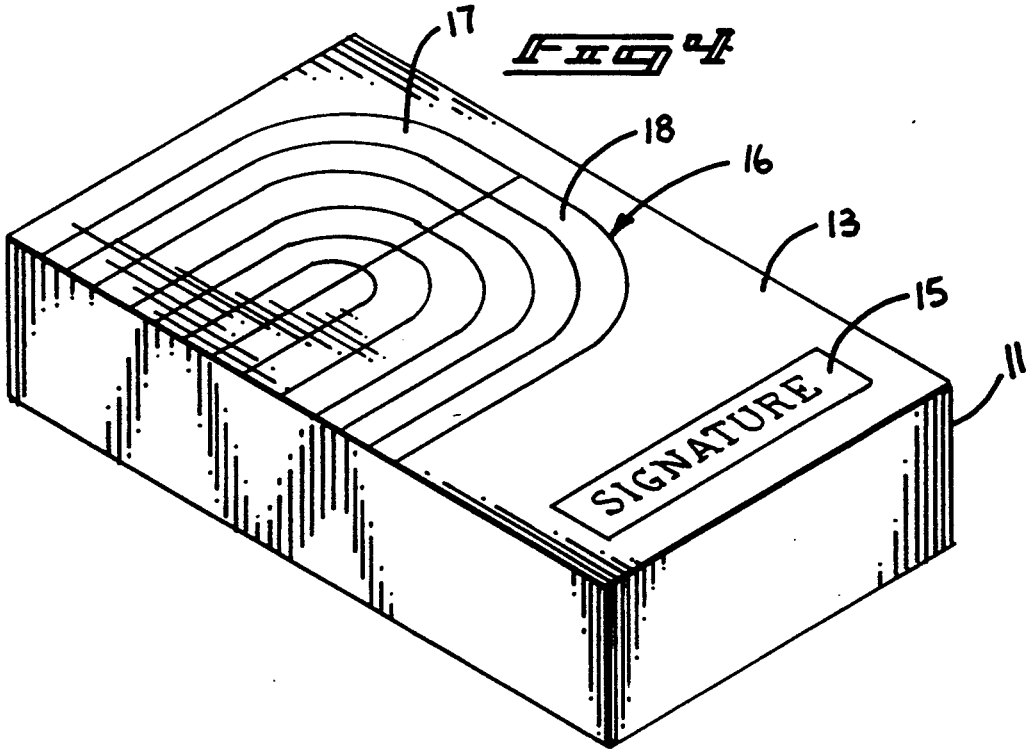
FIG. 4 is an isometric illustration of a further configuration of the instant invention.
Figure 5:
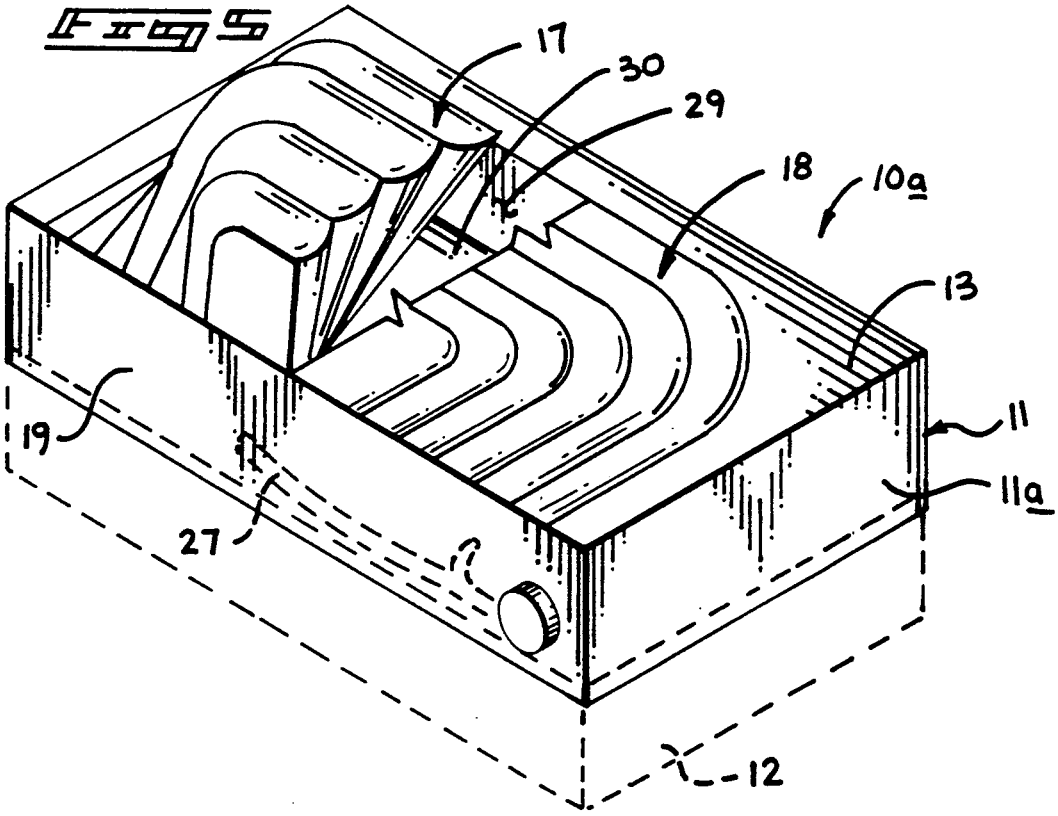
FIG. 5 is an isometric illustration of the invention, with the bellows in a staged and raised orientation relative to the lid structure.
Figure 6:
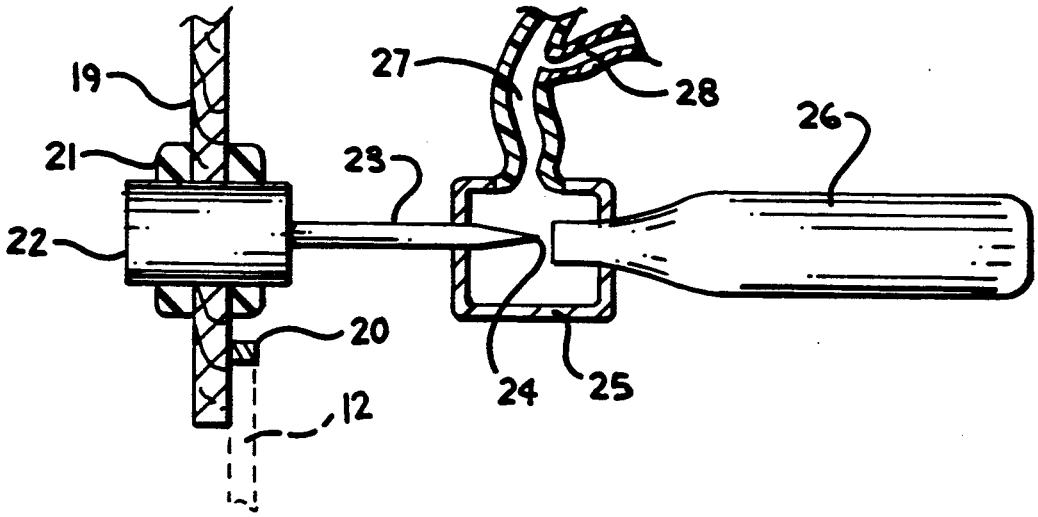
FIG. 6 is an orthographic cross-sectional illustration of the pneumatic manifold and associated conduits to direct selective inflation of the bellows structure, as illustrated in FIG. 5.
Figure 7:
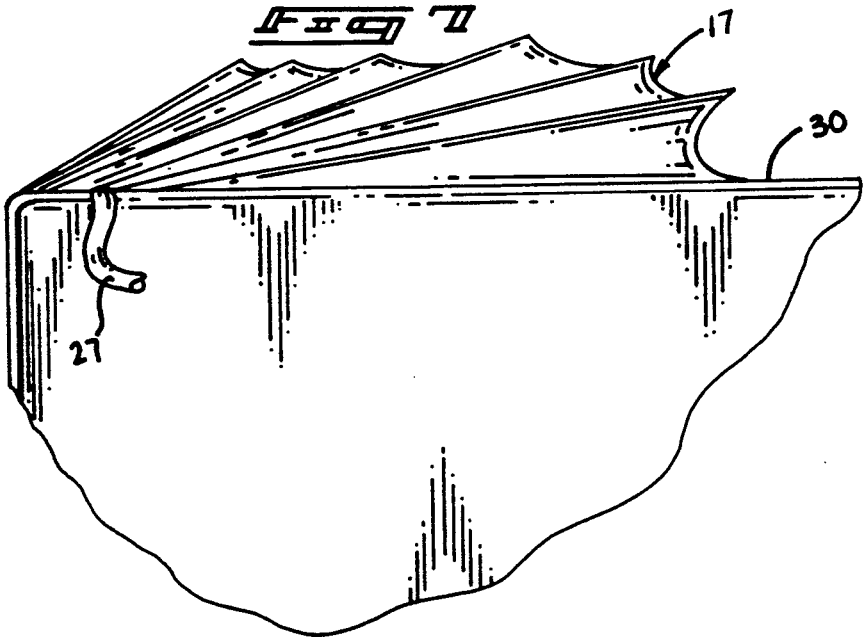
FIG. 7 is an isometric illustration of the bellows and associated conduit.
Figure 8:
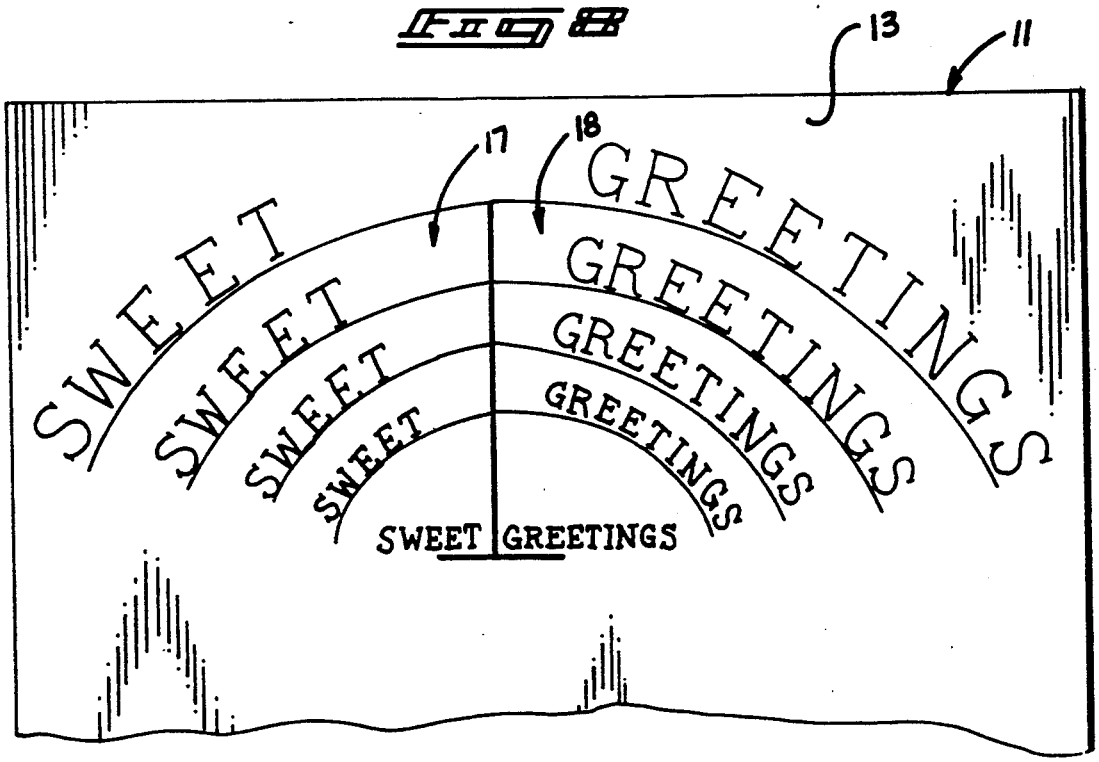
FIG. 8 is a top orthographic view of a typical message formed on the bellows structure.

FIG. 4 illustrates the package construction wherein an accordion message display 16 is received within the lid 11 and is formed of a first and second respective accordion bellows assembly 17 and 18 mounted within the lid. More specifically, a modified aspect of the accordion assemblage is illustrated in FIG. 5 as the package organization 10*a*, wherein the respective first and second accordion bellows assembly 17 and 18 are received within a lid cavity 29 directed into the lid through the top surface 13 formed with a lid cavity floor 30. The lid cavity floor 30 includes an abutment rib 20 fixedly mounted to an interior surface of the skirt 11*a* to an interior surface thereof and coextensively about the skirt to receive the underlying container member 12 therewithin to provide an abutment for a top edge portion of the underlying container member 12. A support bushing 21 directed through a lid side wall 19 of the skirt 11*a* includes a support busing 21 slidably mounting a boss plug 22 therethrough. The boss plug includes a piercing shaft 23 coaxially and integrally mounted to the boss plug 22 and extending interiorly of the container lid 11 directed within a pneumatic manifold 25. The piercing shaft 23 includes a forward pointed end 24, wherein the end 24 is in adjacency to a pressurizing gas cartridge 26 mounted within the pneumatic manifold 25 in coaxial alignment with the piercing shaft 23. Upon projection of the plug 22 interiorly of the side wall 19, the pointed end 24 pierces the gas cartidge 26 and effects pressurizing of a first and second respective pneumatic conduit 27 and 28. The first pneumatic conduit 27 is directed to the first bellows 17, with the second pneumatic conduit directed to the second bellows 18. It should be noted that the first conduit 27 is of a greater diameter than the second conduit 28 for stages inflation of the first bellows relative to the second bellows, wherein the first bellows is inflated initially followed by the second bellows 18 for enhanced visual display of the message, as typically imparted upon the bellows and as illustrated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A package organization comprising, in combination, a container lid, the container lid including a lid top surface, with the lid top surface including a downwardly depending skirt, and an underlying container member received within the container lid, and a message mounted in alignment with the lid top surface, and wherein the container lid includes a lid cavity directed downwardly into the lid from the top surface, with the lid cavity including a cavity floor, and the lid cavity including an accordion message display mounted within the lid cavity and positioned within the lid cavity in the first position and extending above the lid cavity in a second position, and inflation means to effect displacement of the accordion message display from the first position to the second position.

2. An apparatus as set forth in claim 1 wherein the accordion message display includes a first accordion bellows assembly and a second accordion bellows assembly, and the inflation means includes a pneumatic manifold mounted within the container lid, and the pneumatic manifold including a first pneumatic conduit directed to the first accordion bellows display in pneumatic communication with the pneumatic manifold, and a second pneumatic conduit directed from the pneumatic manifold to the second accordion bellows display in pneumatic communication with the pneumatic manifold, and a pressurized gas cartridge mounted within the pneumatic manifold, and a piercing shaft mounted within a lid, with the piercing shaft including a forward pointed end, wherein the forward pointed end is mounted within the pneumatic manifold adjacent the pressurized gas cartridge, and the piercing shaft and the pressurized gas cartridge are coaxially aligned, and a boss plug slidably mounted within the skirt, wherein the boss plug is slidably mounted within a support bushing, wherein the support bushing is mounted within the skirt, and wherein the boss plug is coaxially aligned with the piercing shaft, whereupon projection of the boss plug within the skirt effects piercing of the gas cartridge by the forward pointed end of the piercing shaft.

3. An apparatus as set forth in claim 2 wherein the first pneumatic conduit is of a first diameter and the second pneumatic conduit is of a second diameter, wherein the second diameter is substantially less than the first diameter to effect staged inflation of the first accordion bellows assembly relative to the second accordion bellows assembly.

4. An apparatus as set forth in claim 3 wherein the underlying container member includes an upper edge, and the skirt includes an interior surface underlying the inflation means, and wherein the interior surface includes an abutment rib coextensively mounted within the interior surface to receive the upper edge and arrest projection of the underlying container member within the container lid.

* * * * *